US008577249B2

(12) United States Patent
Adachi et al.

(10) Patent No.: US 8,577,249 B2
(45) Date of Patent: Nov. 5, 2013

(54) IMAGE FORMING APPARATUS WITH SELF-CLEANING

(75) Inventors: Motoki Adachi, Ashigarakami-gun (JP); Masanori Tanaka, Mishima (JP); Hideo Kihara, Suntou-gun (JP); Takashi Mukai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 13/087,871

(22) Filed: Apr. 15, 2011

(65) Prior Publication Data

US 2011/0268468 A1 Nov. 3, 2011

(30) Foreign Application Priority Data

Apr. 30, 2010 (JP) ..... 2010-105942

(51) Int. Cl.
*G03G 15/16* (2006.01)

(52) U.S. Cl.
USPC ..... 399/101

(58) Field of Classification Search
USPC ..... 399/101, 71, 123
See application file for complete search history.

(56) References Cited

U.S. PATENT DOCUMENTS

| | | | | |
|---|---|---|---|---|
| 6,215,975 | B1 | 4/2001 | Berkes et al. | |
| 6,477,348 | B2 * | 11/2002 | Miyamoto et al. | 399/299 |
| 2007/0286636 | A1 * | 12/2007 | Inada et al. | 399/101 |
| 2008/0213010 | A1 * | 9/2008 | Oyama et al. | 399/313 |
| 2009/0196663 | A1 * | 8/2009 | Yasumaru et al. | 399/308 |
| 2009/0317138 | A1 | 12/2009 | Kawasaki et al. | |
| 2011/0318069 | A1 * | 12/2011 | Nishizawa | 399/308 |

FOREIGN PATENT DOCUMENTS

| | | | |
|---|---|---|---|
| JP | 11-15299 | A | 1/1999 |
| JP | 2005-107052 | A | 4/2005 |
| JP | 2007-93780 | A | 4/2007 |
| JP | 2007-241013 | A | 9/2007 |
| JP | 2008-012876 | A | 1/2008 |
| JP | 2009-48051 | A | 3/2009 |
| JP | 2009-204809 | A | 9/2009 |
| JP | 2010-145816 | A | 7/2010 |

OTHER PUBLICATIONS

Notification of the First Office Action dated Apr. 27, 2013, in Chinese Application No. 201110110132.6.

* cited by examiner

*Primary Examiner* — G. M. Hyder
(74) *Attorney, Agent, or Firm* — Fitzpatrick, Cella, Harper & Scinto

(57) ABSTRACT

The image forming apparatus includes an image bearing member; a transfer belt used to transfer a toner image from the image bearing member to a transfer material; a transfer unit adapted to form a transfer nip in conjunction with the image bearing member through the transfer belt; and a control part adapted to control a rotation direction of the transfer belt, wherein in a cleaning mode, the control part rotates the transfer belt in a direction opposite to the rotation direction of the transfer belt during image formation at least by an amount equal to or larger than width of the transfer nip in the rotation direction of the transfer belt. This prevents foreign material from being trapped between the transfer belt such as an intermediate transfer belt or transfer material conveyance belt and a sheet member and thereby reduces density irregularities in a longitudinal direction of the belt.

12 Claims, 8 Drawing Sheets

IMAGE FORMING APPARATUS WITH SELF-CLEANING

BACKGROUND OF THE INVENTION

1. Field of the Invention

The present invention relates to an image forming apparatus such as an electrophotographic copier, laser printer or facsimile machine.

2. Description of the Related Art

An electrophotographic method using toner is often used for the image forming apparatus such as an electrophotographic copier, laser printer or facsimile machine. The electrophotographic method includes a transfer step of electrostatically transferring toner images, i.e., developed images, carried on a photosensitive drum which acts as an image bearing member to a surface of a transfer material or intermediate transfer belt.

Japanese Patent Application Laid-Open No. 2009-204809 discloses a configuration in which a transfer member is placed across a transfer material conveyance belt or intermediate transfer belt from a photosensitive drum (i.e., placed on the back side of the transfer material conveyance belt or intermediate transfer belt) by being fixed to a support member such as a transfer sheet and put in contact with the belt without rotating with respect to the support member. The belt and the transfer member can form a relatively large contact surface area, resulting in improved transferability. However, the transfer member, which is fixed to the support member and placed in contact with the belt without rotating with respect to the support member, has the following problem.

Foreign material such as dust may sometimes get inside the belt. When such dust enters between the inner face of the belt and the transfer member, condition of contact between the belt and the transfer member becomes non-uniform in a longitudinal direction of the belt orthogonal to the movement direction of the belt. When the condition of contact becomes non-uniform in the longitudinal direction of the belt, a phenomenon of density irregularities will occur when a toner image is transferred from the image bearing member. The phenomenon of density irregularities involves vertical streaks in the belt movement direction or bands of shading. This is considered to be because the dust trapped between the inner face of the belt and the transfer member causes an unstable state of discharge in the longitudinal direction or differences in longitudinal pressure distribution to thereby cause irregular abrasion on the image bearing member.

SUMMARY OF THE INVENTION

A purpose of the present invention to provide an image forming apparatus which can prevent foreign material from being trapped between a belt such as an intermediate transfer belt or transfer material conveyance belt and a transfer member put in contact with the belt by being supported by a support member without rotating with respect to the support member and thereby reduce density irregularities in a longitudinal direction.

Another purpose of the present invention is to provide an image forming apparatus, including a rotatable image bearing member that bears a toner image, a rotatable and endless transfer belt through which the toner image is transferred from the image bearing member onto a transfer material, a transfer unit that forms a transfer nip with the image bearing member through the transfer belt, the transfer unit including a contact member that has a contact surface adapted to contact an inner surface of the transfer belt and a support member that supports the contact member, wherein the contact member comes into contact with the transfer belt during rotation of the transfer belt without rotating with respect to the support member and transfers the toner image from the image bearing member when a voltage is applied, and a control part that controls a rotation direction of the transfer belt, wherein the image forming apparatus is capable of performing a cleaning mode for cleaning a contact area in which the transfer belt contacts the contact member in the transfer nip, and wherein in a case where the cleaning mode is performed, the control part rotates the transfer belt in the direction opposite to the rotation direction of the transfer belt during image formation at least by an amount equal to or larger than a width of the transfer nip in the rotation direction of the transfer belt.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An image forming apparatus according to the present invention will be described below in more detail with reference to the drawings. However, the sizes, materials, shapes, and relative locations of the components described in the following embodiments are to be changed as required depending on the configuration and conditions of the apparatus to which the present invention is applied, and the scope of the present invention is not limited to the embodiments described below.

First Embodiment

An image forming apparatus according to a first embodiment of the present invention will be described below with reference to FIGS. 1 to 5A and 5B.

(Overall Configuration of Image Forming Apparatus)

Figure 1:
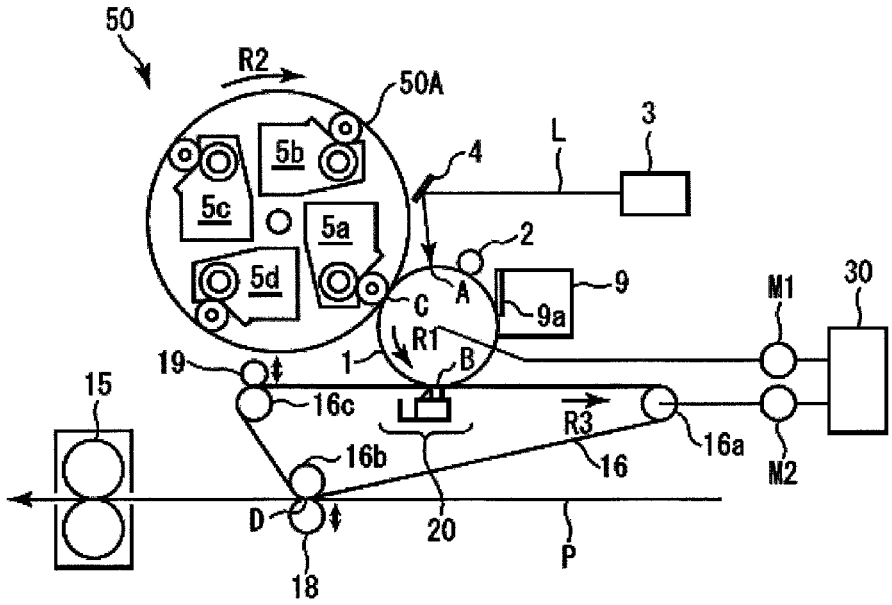
FIG. 1 illustrates a schematic sectional configuration of an image forming apparatus according to an embodiment of the present invention.

A schematic configuration of the image forming apparatus according to the present embodiment is illustrated in FIG. 1. According to the present embodiment, the image forming apparatus includes a photosensitive drum 1, i.e., a drum-shaped electrophotographic photosensitive body acting as an image bearing member. The photosensitive drum 1 can be rotated in the direction of arrow R1 by a drive unit M1.

A charge roller 2, an exposure unit 3 and a rotary developing unit 50 are placed around the photosensitive drum 1. A laser beam L sent from the exposure unit 3 is directed at an exposure position A on the photosensitive drum 1 via a reflecting mirror 4.

A rotary developing unit 50 is mounted on a rotary drum 50A which supports developing devices 5 (5*a*, 5*b*, 5*c* and 5*d*) containing yellow toner, magenta toner, cyan toner and black toner, respectively. All the developing devices 5*a*, 5*b*, 5*c* and 5*d* have the same internal configuration, and thus will be referred to as the developing device(s) 5 when the toners contained therein are not distinguished particularly.

As described above, all the developing devices 5 are configured to be mountable on the rotary drum 50A. The rotary drum 50A is rotatably supported with the developing devices 5 mounted thereon, and is able to move a desired developing device 5 (e.g., the developing device 5*a*) to a developing position C placed in face-to-face contact with the photosensitive drum 1 by rotating the developing device 5.

Figure 2:
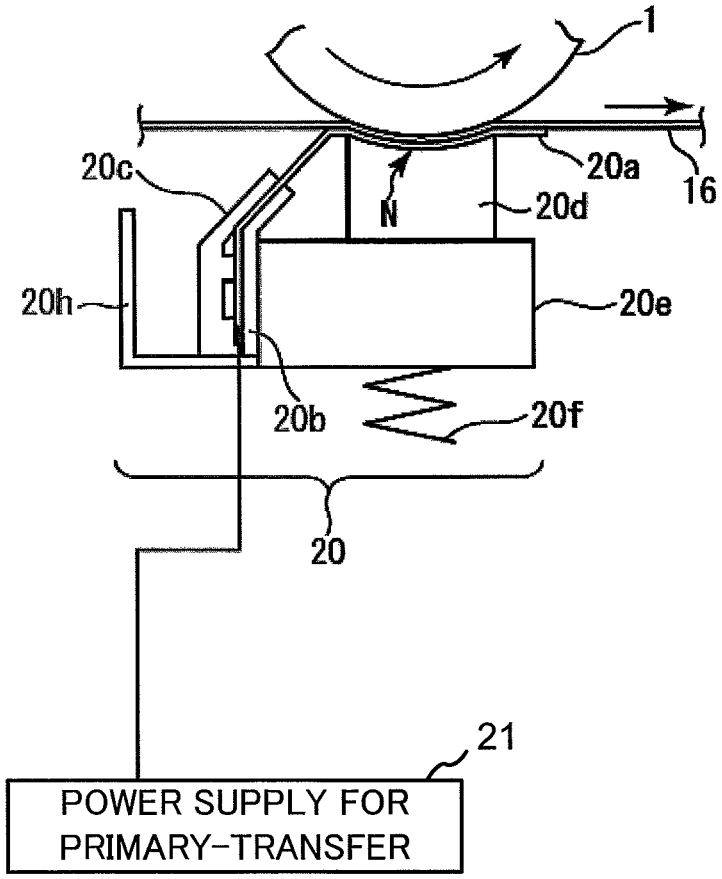
FIG. 2 illustrates a schematic section of a primary transfer configuration according to a first embodiment of the present invention.

An intermediate transfer member in the form of a belt, i.e., an intermediate transfer belt (hereinafter referred to simply as a "transfer belt") 16, is tensioned by multiple rollers 16*a*, 16*b* and 16*c* below the photosensitive drum 1. The transfer belt 16 can be moved in the direction of arrow R3 in FIG. 1 by a drive unit M2 connected to the drive roller 16*a*. Referring to FIG. 2, at a primary transfer position at which the photosensitive drum 1 and transfer belt 16 come into pressing contact with each other, a primary transfer unit 20 is placed inside the transfer belt 16. A primary transfer sheet (hereinafter referred to simply as a "transfer sheet") 20*a* which is a sheet member in the primary transfer unit 20 is placed, sandwiching the transfer belt 16 in conjunction with the photosensitive drum 1. Configuration of the primary transfer unit 20 will be described in detail later.

A secondary transfer roller 18 is placed so as to sandwich the transfer belt 16 in conjunction with the roller 16*b* which is one of the rollers over which the transfer belt 16 is tensioned. The secondary transfer roller 18 is configured to be able to be abutted against and separated from the transfer belt 16. The roller 16*b* is called a secondary transfer counter roller in distinction from the secondary transfer roller 18. The position where the secondary transfer roller 18 is abutted and separated is called a secondary transfer position D. At the secondary transfer position D, images are transferred to a conveyed transfer material P, as described later. After the image transfer, the transfer material P is sent to a fixing unit 15.

A secondary transfer toner residue charging device 19 is installed downstream of the secondary transfer position D in the travel direction of the transfer belt 16. According to the present embodiment, a secondary transfer toner residue charging device 19 which is a charge roller is placed so as to be able to come into and out of contact with the transfer belt 16 in order to charge secondary transfer toner residues. For the photosensitive drum 1, a photosensitive body cleaning apparatus 9 is installed downstream of a primary transfer position B in the movement direction of the photosensitive drum 1. Also, an ancillary blade 9*a* is placed in contact so as to be able to scrape toner off the photosensitive drum 1. Incidentally, a cleaning unit equipped with a blade which comes into contact with an outer surface of the belt may be installed instead of the toner charging device 19 to recover the secondary transfer toner residues directly from the outer surface of the belt.

Image forming operation of the image forming apparatus will be described.

A surface of the photosensitive drum 1 rotating at 100 mm/sec in the direction of arrow R1 is charged to a predetermined potential by the charge roller 2. Electrostatic latent images are formed on the photosensitive drum 1 at the exposure position A by a laser beam L emitted via the exposure unit 3 and reflecting mirror 4 according to image signals of different colors. The electrostatic latent images thus formed are developed at the developing position C by the developing devices 5 to form toner images. The developing devices 5 placed at the developing position C have been established according to the image signals of respective colors, and the developing device 5 of a desired color is placed at the developing position C in advance by rotating the rotary drum 50A in the direction of arrow R2. The toner images are developed in a predetermined order of colors. According to the present embodiment, the toner images are formed in the order: yellow, magenta, cyan and black.

The toner images formed on the photosensitive drum 1 are transferred in sequence to the intermediate transfer belt 16 at the primary transfer position B. As the toner images are superimposed one over another, a full-color toner image is formed on the intermediate transfer belt 16. The secondary transfer roller 18 and secondary transfer toner residue charge roller are separated from the transfer belt 16 until the full-color toner image is formed, and are abutted against the transfer belt 16 after the full-color toner image is formed. The transfer material P is conveyed, being timed with arrival of the formed full-color toner image at the secondary transfer position D. The secondary transfer roller 18 and secondary transfer counter roller 16*b* sandwiches the transfer material P together with the transfer belt 16 therebetween to transfer the full-color toner image to the transfer material P. The transfer material P to which the full-color toner image has been transferred is sent to the fixing unit 15. The fixing unit 15 fixes the full-color toner image on the transfer material P by heating the full-color toner image under pressure to create a final image.

The toner remaining on the transfer belt 16 after the secondary transfer is charged oppositely to regular polarity of the toners by the secondary transfer toner residue charge roller 19, electrically reverse-transferred onto the photosensitive drum 1 at the primary transfer position B, and subsequently recovered by the cleaning apparatus 9 disposed on the photosensitive drum 1.

According to the present embodiment, the drive unit M1 of the photosensitive drum 1 and drive unit M2 of the transfer belt 16 are provided separately, and both rotation direction and speed thereof can be switched separately by a drive control unit 30 (control part).

(Configuration of Primary Transfer Unit)

The configuration of the primary transfer unit 20 according to the present embodiment will be described below with reference to FIG. 2.

The primary transfer unit 20 has a sheet member, specifically, a transfer sheet 20*a* on the opposite side of the intermediate transfer belt 16 from the photosensitive drum 1. The transfer sheet 20*a* comes into contact with the intermediate transfer belt 16 from the side opposite to the photosensitive drum 1. That is, the primary transfer unit has a contact member which comes into contact with the back face of the transfer belt 16. According to the present embodiment, the contact member is implemented as the transfer sheet 20*a*. The contact member is supported by a support member, and comes into contact with the transfer belt during rotation of the transfer belt without rotating with respect to the support member. Incidentally, according to the present embodiment, an ultra-high-molecular-weight polyethylene sheet of 230 mm in longitudinal width is used as the transfer sheet 20*a*.

The volume resistivity of the ultra-high-molecular-weight polyethylene is $10^3$ to $10^4$ Ωcm at an applied voltage of 5 V, and does not change greatly in environments ranging from a low temperature/low humidity environment of 15° C. and 20% RH to a high temperature/high humidity environment of 30° C. and 80% RH.

Also, the transfer sheet 20*a* is connected with a power supply 21 for primary transfer illustrated in FIG. 2. To transfer a toner image from the photosensitive drum 1 to the intermediate transfer belt 16, a voltage is applied from the power supply 21 for primary transfer to the transfer sheet 20*a*.

At one end, the transfer sheet 20*a* is supported by being sandwiched between a sheet support member 20*b* and sheet cover 20*c*. The sheet support member 20*b* and sheet cover 20*c* are support members of the transfer sheet 20*a*.

Incidentally, that end of the transfer sheet 20*a* which is supported by the support members is located on the upstream side in the movement direction of the transfer belt 16 illustrated in FIG. 2, and thus referred to hereinafter as the "upstream end." On the other hand, the end (free end) opposite to the upstream end is referred to as the "downstream end."

According to the present embodiment, the sheet cover 20*c* is made of PS/ABS resin while the sheet support member 20*b* is made of a stainless steel sheet.

To support the upstream end of the transfer sheet 20*a*, the transfer sheet 20*a* is bonded to a surface of the sheet support member 20*b* by an adhesive member and an outer side of the transfer sheet 20*a* is covered and supported by the sheet cover 20*c*. The downstream end of the transfer sheet 20*a* is a free end. Also, an elastic member 20*d* abuts the downstream end of the transfer sheet 20*a* from the side opposite to the transfer belt 16, pressing the transfer sheet 20*a* toward the transfer belt 16.

The elastic member 20*d* is held from below by an elastic member holding member 20*e*. Furthermore, the elastic member holding member 20*e* is urged toward the transfer belt 16 from below by a transfer pressure member 20*f* such as a spring member.

This configuration allows the downstream end of the transfer sheet 20*a* to abut the transfer belt 16 from the side opposite to the photosensitive drum 1 at a predetermined pressure.

According to the present embodiment, the elastic member 20*d* is made of spongy urethane foam with an Asker C hardness of 18° at a load of 1 kg and is approximately rectangular in shape, measuring 5 mm thick by 5 mm wide by 230 mm long.

Incidentally, although in the present embodiment, spongy urethane foam is used for the elastic member 20*d*, rubber material such as epichlorohydrin rubber, NBR or EODM or solid elastic rubber material may be used alternatively. Furthermore, there is no need to stick to rubber material, and similar effects can be obtained even when other material such as resin or elastomer is used for the elastic member 20*d* as long as the material has elasticity.

Thus, with the upstream end supported firmly and the downstream end being a free end, the transfer sheet 20*a* according to the present embodiment is configured to be able to abut the transfer belt 16 by being pressed against the transfer pressure member 20*f* via the elastic member 20*d* and elastic member holding member 20*e*.

To obtain good transfer performance, it is necessary to provide a predetermined transfer nip width while maintaining a uniform abutting condition between the transfer sheet 20*a* and transfer belt 16. In the image forming apparatus according to the present embodiment, a transfer nip width of about 5 mm is secured.

Figure 3:
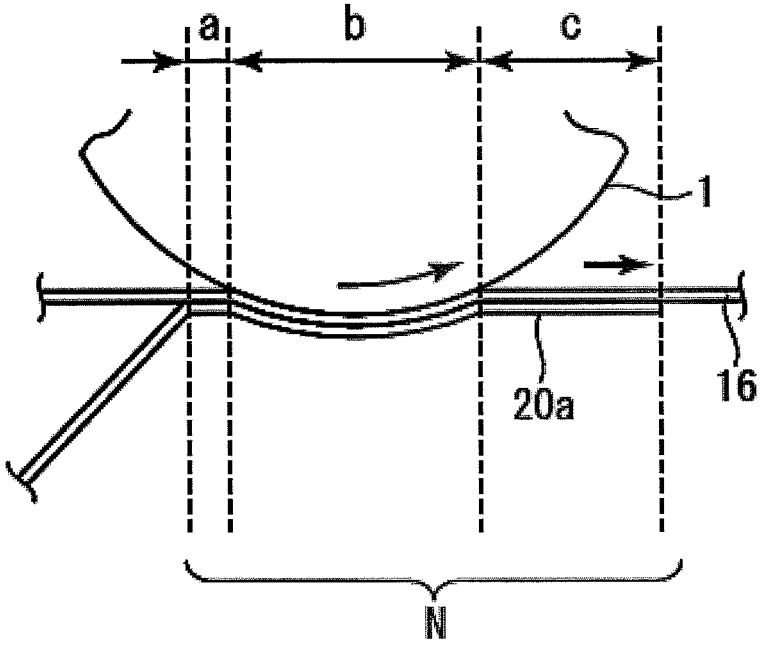
FIG. 3 illustrates a cross section of a nipped transfer sheet and transfer belt.

Constituents of the transfer nip N according to the present embodiment will be described with reference to FIG. 3. FIG. 3 is an enlarged view of the transfer nip N according to the present embodiment.

The nip width of the transfer nip N according to the present embodiment is 5 mm. As illustrated in FIG. 3, the transfer nip N can be divided into an upstream tension nip (a), physical nip (b) and downstream tension nip (c), whose widths are 0.5 mm, 2.5 mm, and 2 mm, respectively.

The physical nip (b) is a contact portion between the photosensitive drum 1 and transfer belt 16 when the transfer belt 16 is sandwiched between the photosensitive drum 1 and transfer sheet 20*a*. This portion is also in contact with the transfer sheet 20*a* on the opposite side.

The tension nips (a) and (c) are those portions of the transfer belt 16 which, being formed both upstream and downstream of the physical nip (b), contact only the transfer sheet 20*a* without contacting the photosensitive drum 1.

According to the present embodiment, since tension is applied to the downstream end of the transfer sheet 20*a* as described above, a desired transfer nip width N can be secured without increasing abutting pressure on the transfer belt 16.

Specifically, according to the present embodiment, a transfer nip width of approximately 5 mm can be obtained if the transfer sheet 20*a* is pressed toward the photosensitive drum 1 at a pressure of approximately 400 gf by the pressure member 20*f* illustrated in FIG. 2. This configuration enables providing a sufficient nip width and forming a uniform nip N.

Recently, with the diversification of users, image forming apparatus have come to be used in various environments. For example, image forming apparatus are often affected by dust and the like, and dust entering inside the transfer belt 16 can be trapped between the transfer belt 16 and transfer sheet 20*a*. Also, extended life increases rubbing between the transfer belt 16 and transfer sheet 20*a*, and consequently chips produced by rubbing between the transfer belt 16 and transfer sheet 20*a* can be trapped between the transfer belt 16 and transfer sheet 20*a*. These problems can come to affect images with increases in the life and image quality of the apparatus.

Now, phenomena which can occur when foreign material such as dust is trapped between the transfer belt 16 and transfer sheet 20*a* will be described in detail.

If foreign material is trapped near the upstream tension nip (a), the nip N becomes non-uniform, giving rise to abnormal electrical discharges with respect to the photosensitive drum 1 via the transfer belt 16. The electrical discharges can disturb pre-transfer images, resulting in density irregularities (vertical thin lines in the belt movement direction or vertical stripes) in the longitudinal direction of the resulting image. Even if density irregularities do not appear on the image, if this state continues, abrasion can progress in that part of the photosensitive drum 1 which is subjected to the abnormal electrical discharges. Streaky irregular abrasion can occur in the circumferential direction of photosensitive drum 1, resulting in a sensitivity difference between the much abraded part and other part and thereby causing density irregularities in the form of vertical streaks in the resulting image. In particular, with a rotary image forming apparatus as in the case of the present embodiment, the photosensitive drum 1 has as long a life as the image forming apparatus itself. Consequently, effects of even minute discharge irregularities will be accumulated, appearing eventually in the image. Also, when a color image is formed by a rotary image forming apparatus as in the case of the present embodiment, the same primary transfer unit carries out primary transfer of toner images four times from the photosensitive drum 1 to the transfer belt 16. Consequently, the effects of minute discharge irregularities are transferred to the transfer material and are liable to appear in the fixed image.

Furthermore, if foreign material enters the physical nip (b), the transfer sheet 20*a* will fail to contact the transfer belt 16 in some part, resulting in deficiency of transfer current, which can cause defective conditions, i.e., vertical streaks, in the resulting image.

In this way, since foreign material trapped between the transfer belt 16 and transfer sheet 20*a* might cause defective conditions in images, the present embodiment is provided with a cleaning mode to remove foreign material from between the transfer belt 16 and transfer sheet 20*a*.

(Cleaning Mode)

The cleaning mode will be described in detail below.

Figure 4:
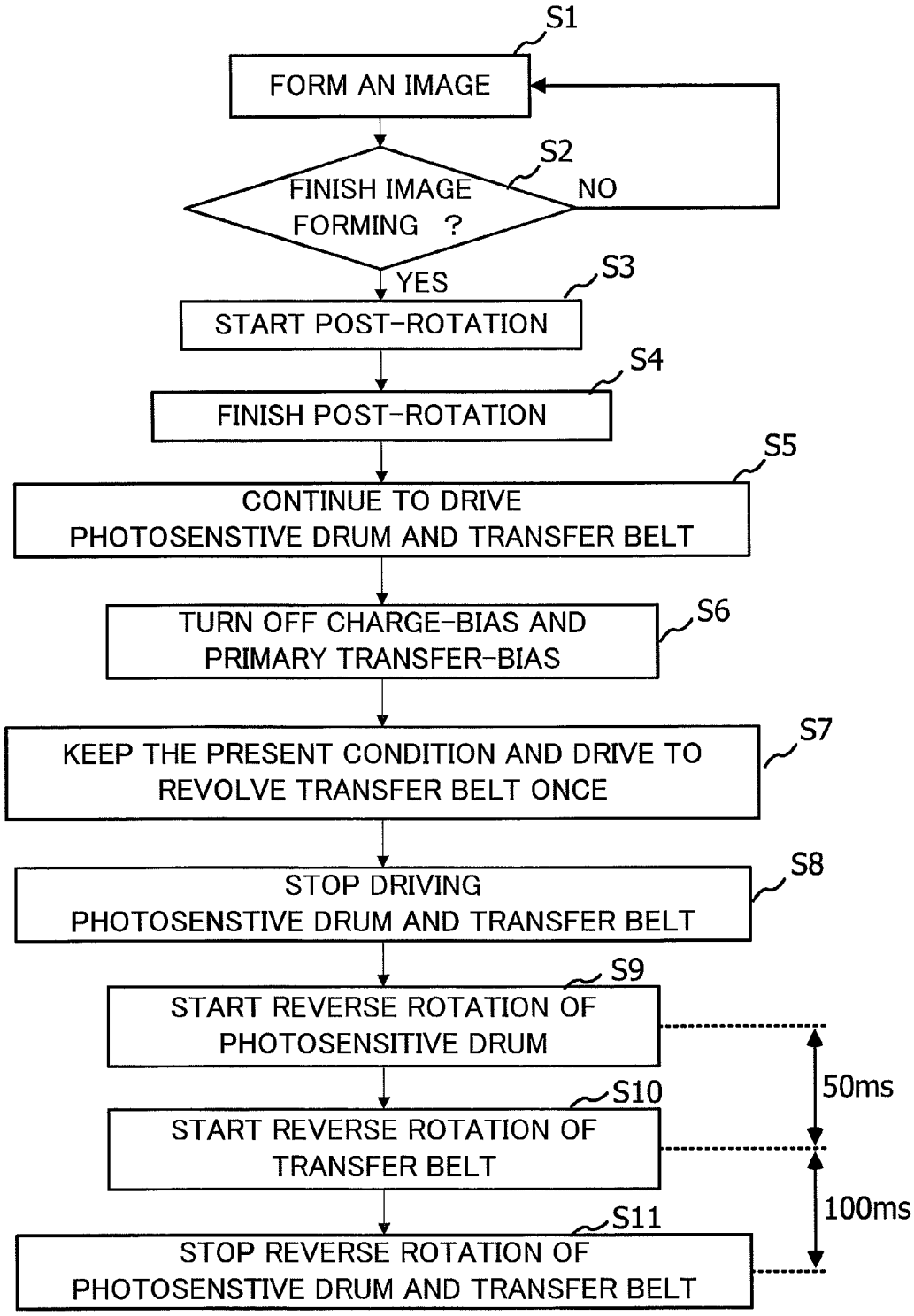
FIG. 4 illustrates a flowchart of a transfer sheet cleaning sequence according to one embodiment.

An operation flow of the cleaning mode is illustrated in FIG. 4. After image formation is finished, a normal post-rotation process is performed (S1 to S3). The post-rotation process is a sequence for rotating the transfer belt 16 a few times with a primary transfer bias and charge bias applied. The post-rotation process is performed to clean the toner remaining on the transfer belt after a secondary transfer step is finished. The rotation direction of the transfer belt 16 during the post-rotation process is the same as the rotation direction during image formation. Hereinafter, the rotation in the same direction as during image formation will be defined as forward rotation and the rotation in a direction opposite to the direction during image formation will be defined as reverse rotation. Incidentally, the post-rotation process may be performed at a time other than in the cleaning mode.

After the post-rotation process is finished (S4), with the photosensitive drum 1 and the transfer belt 16 kept being driven rotationly (S5), the primary transfer bias applied to the primary transfer unit and the charge bias applied to the charge unit are turned off (S6). After the photosensitive drum 1 is put into rotation, the transfer belt 16 is idled approximately one turn (S7). Subsequently, the transfer belt 16 and the photosensitive drum 1 are stopped being driven (S8). Next, the photosensitive drum 1 is driven so as to rotate reversely (S9), and approximately 50 milliseconds after the photosensitive drum 1 starts rotation, the transfer belt 16 is driven so as to rotate reversely (S10). When the transfer belt is moved approximately 10 mm (rotationly driven approximately 100 milliseconds), the reverse rotation of the photosensitive drum 1 and the transfer belt 16 is stopped (S11).

The foreign material trapped between the transfer belt 16 and transfer sheet 20*a* is removed by moving the transfer belt 16 in a direction opposite to that during image formation by a distance equal to or larger than the transfer nip width between the transfer sheet 20*a* and transfer belt 16.

Movements of foreign materials (A to C) trapped between the transfer belt 16 and transfer sheet 20*a* when the sequence is performed will be described with reference to FIG. 5.

The foreign material A exists upstream of a tension nip, the foreign material B exists in a tension nip, and the foreign material C exists in the physical nip. The foreign materials (A to C) trapped between the transfer belt 16 and transfer sheet 20*a* are subjected to a force tending to move upstream with the movement of the transfer belt 16. Consequently, the foreign materials are ejected from between the transfer belt 16 and transfer sheet 20*a* and fall downward by the force of gravity. The fallen foreign materials are collected by a foreign material receiving member 20*h* illustrated in FIG. 2 in such a way as not to stick to the transfer belt 16.

Individual operations of a transfer sheet cleaning sequence will be described below.

Figure 5A:
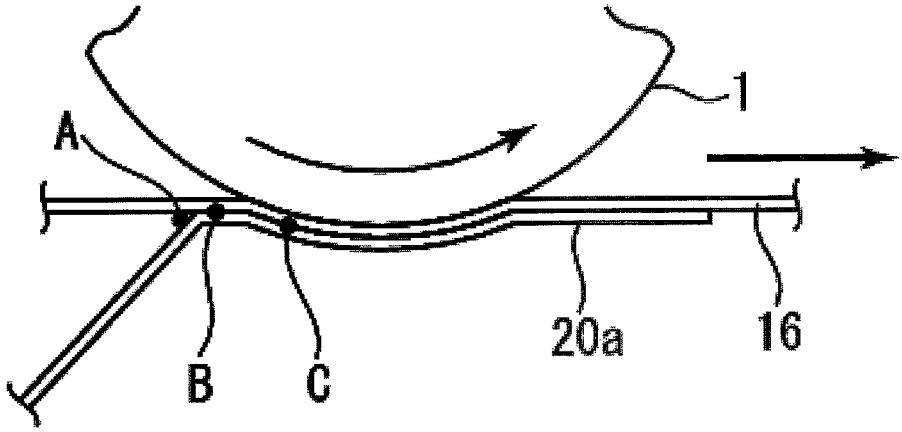
FIG. 5A illustrates a condition before and after a transfer sheet cleaning sequence during image formation.
Figure 5B:
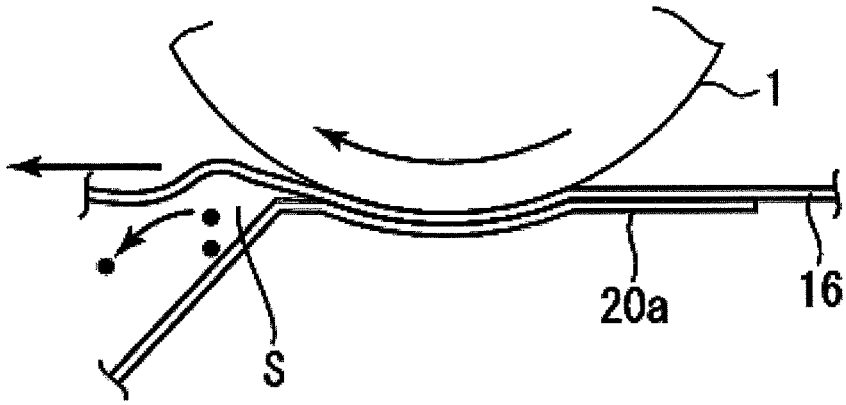
FIG. 5B illustrates a condition before and after a transfer sheet cleaning sequence during the transfer sheet cleaning sequence.

The photosensitive drum 1 is rotated reversely prior to the transfer belt 16. During image formation illustrated in FIG. 5A, upstream of the photosensitive drum in the movement direction of the transfer belt 16, tension is applied to the transfer belt 16. As the photosensitive drum 1 is rotated reversely prior to the transfer belt 16 as illustrated in FIG. 5B, the tension on the transfer belt 16 is relaxed. Consequently, a space S is created between the transfer sheet 20*a* and transfer belt 16 as illustrated in FIG. 5B, making it easy for foreign materials to come off during the reverse rotation of the transfer belt 16. This allows foreign materials to be removed more efficiently than when the transfer belt 16 is simply rotated reversely.

Also, the reverse rotation performed with the primary transfer bias turned off makes it easy to reduce the electrostatic adherence force between the transfer sheet 20*a* and photosensitive drum 1 and thereby remove the foreign materials trapped between the transfer belt 16 and transfer sheet 20*a*. The force acting to trap objects between the transfer sheet 20*a* and transfer belt 16 is affected by the potential difference between the photosensitive drum 1 and transfer sheet 20*a*. The potential difference, if large, increases the trapping force caused by the electrostatic adherence force. If the trapping force is strong, it is difficult to eject the foreign materials even if the transfer belt 16 is rotated reversely. Thus, the reverse rotation is performed with the primary transfer bias turned off to reduce the attractive force caused by the potential difference, thereby making it easy to eject foreign materials from between the transfer belt 16 and transfer sheet 20*a*.

Furthermore, according to the present embodiment, the photosensitive drum 1 is rotated with the primary transfer bias turned off prior to the reverse rotation to reduce the electric potential of the photosensitive drum 1 and thereby reduce the potential difference between the photosensitive drum 1 and transfer sheet 20*a*. This further reduces the attractive force, making it easier to remove foreign materials. Also, since the transfer belt 16 is rotated in the forward direction at least one turn prior to the reverse rotation, the foreign materials attached to the back face of the transfer belt 16 can be carried to the transfer nip at least once when the cleaning mode is entered. Consequently, the reverse rotation can prevent the foreign materials attached to the back face of the transfer belt 16 downstream of the downstream tension nip from staying in the upstream tension nip.

Another advantage of reducing the electrostatic adherence force between the photosensitive drum 1 and transfer sheet 20*a* is the capability to prevent the transfer sheet 20*a* from being ripped up. As described above, when there is a potential difference between the photosensitive drum 1 and transfer sheet 20*a*, there is a force which pulls the transfer sheet 20*a* toward the transfer belt 16. If the transfer belt 16 is rotated reversely in this state, the transfer sheet 20*a* is pulled by the transfer belt 16, causing the free end of the transfer sheet 20*a* to move in a direction opposite to that under normal conditions, provided that the amount of travel is large. That is, the transfer sheet 20*a*, which is located downstream of the photosensitive drum 1 along a regular movement direction of the transfer belt 16 in normal state, moves to the upstream side. In this state, it is obvious that defective conditions will occur during image formation.

The travel amount of the transfer belt 16 in the reverse direction is approximately 10 mm according to the present embodiment. Considering the nip width (approximately 5 mm) between the transfer sheet 20*a* and transfer belt 16 along the conveyance direction, the transfer belt 16 is moved at least by a distance equal to or larger than the nip width. Consequently, the area along the entire nip width can be brought out of contact once, allowing foreign materials to be removed efficiently.

If the cleaning mode is run periodically, foreign materials, even if trapped between the transfer sheet 20*a* and transfer belt 16, can be removed before becoming serious, and consequently the phenomenon of longitudinal density irregularities (vertical streaks) can be prevented.

Alternatively, the cleaning mode may be run once every predetermined number of sheets or when the number of rotations of the transfer belt 16 or photosensitive drum 1 reaches a predetermined number.

Second Embodiment

Basic configuration of the present embodiment is the same as the first embodiment, and components with the same configuration and functionality as those in the first embodiment are denoted by the same reference numerals as the corresponding components, and detailed description thereof will be omitted. Only characteristic features of the present embodiment will be described below.

Figure 6:
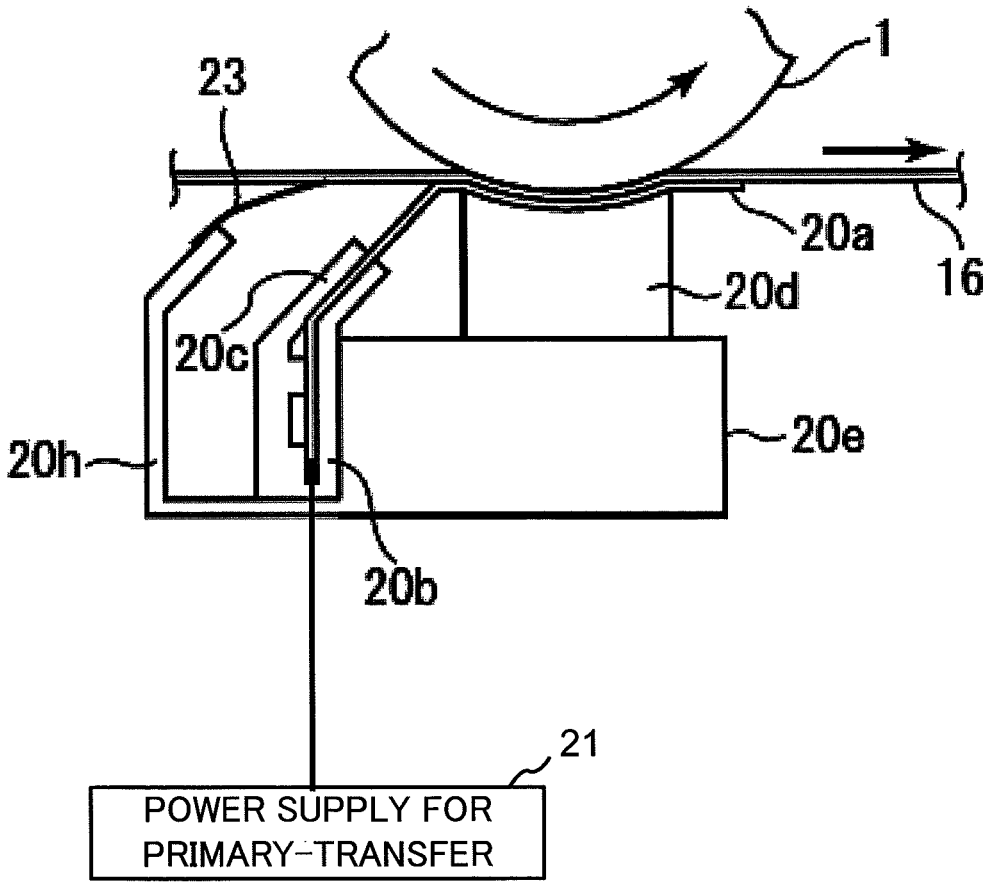
FIG. 6 illustrates a schematic section of a primary transfer configuration according to a second embodiment of the present invention.

A configuration of primary transfer unit according to the present embodiment will be described with reference to FIG. 6.

According to the present embodiment, a cleaning member 23 is provided upstream of the upstream tension nip to clean the back face of the transfer belt 16 by being placed in contact with the back side of the transfer belt 16. The cleaning member 23 is supported by the foreign material receiving member 20*h*. A 50-μm-thick PET sheet is used as the cleaning member 23, which is placed in contact with the transfer belt 16 under light pressure.

According to the present embodiment, when the transfer belt 16 is moved, after the end of image formation, in a direction opposite to the movement direction during image formation, the transfer belt 16 is moved at least by such a distance that a contact portion between the transfer sheet 20*a* and transfer belt 16 will reach the cleaning member 23.

This enables removing the foreign materials which have not fallen from the belt 16 under their own weight during reverse rotation. The cleaning member 23, which is abutted against the transfer belt 16 under light pressure, does not disturb images formed on the transfer belt 16. Furthermore, since the cleaning member 23 is supported by the foreign material receiving member 20*h*, the foreign materials dropped from the transfer belt 16 by their own weight or the cleaning member 23 during reverse rotation can be received by the foreign material receiving member 20*h*.

Other Embodiments

Although in the above embodiments, the present invention has been described as being an intermediate-transfer color image forming apparatus, the present invention is not limited to this.

The present invention may be a direct-transfer color image forming apparatus which records a color image by transferring the toner images formed on the photosensitive drum 1 directly onto a belt-shaped transfer material bearing member, i.e., onto a transfer material P carried and conveyed by a transfer material conveyance belt.

Figure 7:
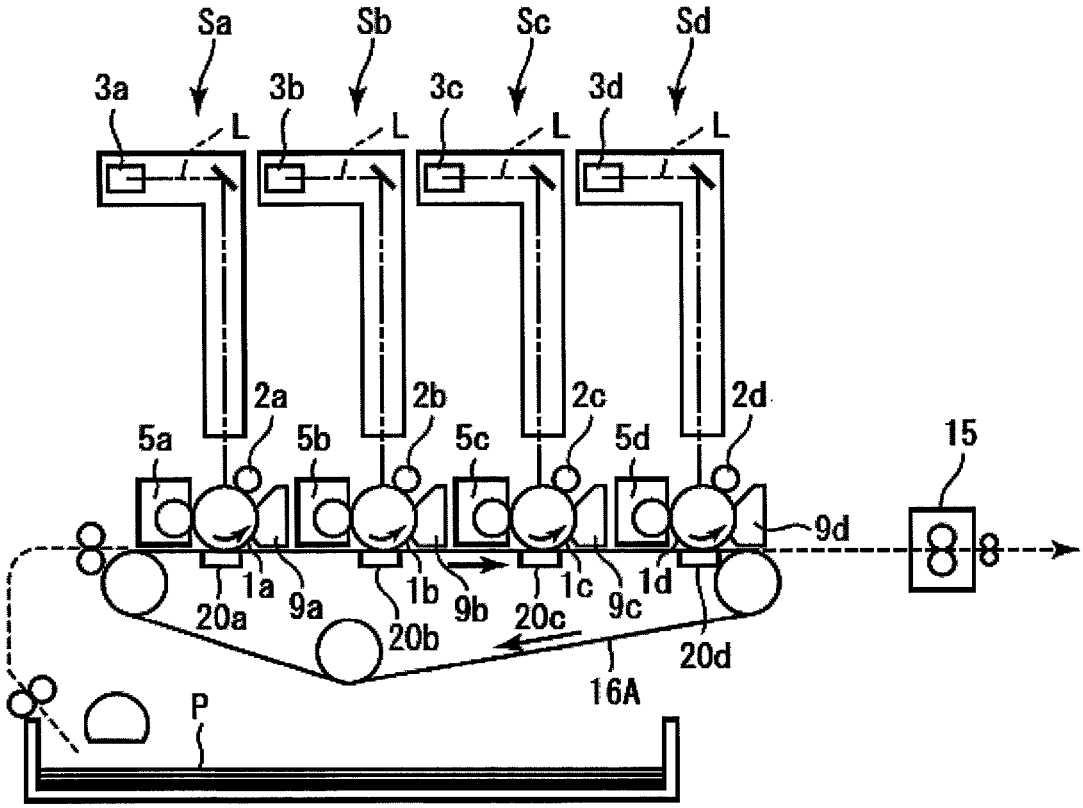
FIG. 7 illustrates a schematic sectional configuration of an image forming apparatus according to another embodiment of the present invention.

Specifically, in the image forming apparatus, for example, as illustrated in FIG. 7, toner images formed on surfaces of respective photosensitive drums 1 (1*a*, 1*b*, 1*c* and 1*d*) are directly transferred in sequence to the transfer material P conveyed to image forming units S (Sa, Sb, Sc and Sd) by a conveyance belt 16A.

In the color image forming apparatus according to the present embodiment, unlike the first and second embodiments described earlier, the image forming units S (Sa, Sb, Sc and Sd) are provided with the conveyance belt 16A to convey the transfer material P instead of the intermediate transfer belt 16 serving as an intermediate transfer member. Then, the toner images formed on the surfaces of the photosensitive drums 1 (1*a*, 1*b*, 1*c* and 1*d*) are transferred by transfer units 20 (20*a*, 20*b*, 20*c* and 20*d*) to the transfer material P conveyed by the conveyance belt, as in the case of the first and second embodiments described earlier.

The rest of the configuration of the image forming apparatus is similar to the image forming apparatus according to the first embodiment. Besides, the configuration and operation of such a direct-transfer color image forming apparatus is known to those skilled in the art. Thus, components with the same configuration and functionality as those in the first embodiment are denoted by the same reference numerals as the corresponding components, and detailed description thereof will be omitted by relying on the description of the first embodiment.

The principles of the present invention described earlier in the first and second embodiments are also applicable to such a direct-transfer color image forming apparatus, achieving similar operation and effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-105942, filed Apr. 30, 2010, which is hereby incorporated by reference herein in its entirety.

What is claimed is:

1. An image forming apparatus, comprising:

a rotatable image bearing member that bears a toner image;

a rotatable and endless transfer belt through which the toner image is transferred from the image bearing member onto a transfer material;

a transfer unit that forms a transfer nip with the image bearing member through the transfer belt, the transfer unit including a contact member that has a contact surface adapted to contact an inner surface of the transfer belt and a support member that supports the contact member, wherein the contact member comes into contact with the transfer belt during rotation of the transfer belt without rotating with respect to the support member and transfers the toner image from the image bearing member; and a control part that controls a rotation direction of the transfer belt, wherein the image forming apparatus is capable of performing a cleaning mode for cleaning a contact area in which the transfer belt contacts the contact member, wherein when a toner image is transferred, the contact member electrostatically adheres to the transfer belt, and wherein when the cleaning mode is performed, the control part first reduces a force in which the contact member electrostatically adheres to the transfer belt, and then rotates the transfer belt in the direction opposite to the rotation direction of the transfer belt during image formation.

2. An image forming apparatus according to claim 1, wherein the control part is controllable to a rotation direction of the image bearing member, and in a case where the cleaning mode is performed, the control part starts rotating the image bearing member in a direction opposite to the rotation direction of the image bearing member during image formation and then starts rotating the transfer belt in the direction opposite to the rotation direction of the transfer belt during image formation.

3. An image forming apparatus according to claim 1, wherein in a case where the cleaning mode is performed, the control part rotates the transfer belt at least by an amount equal to or larger than a width of the transfer nip in the rotation direction of the transfer belt.

4. An image forming apparatus according to claim 1, further comprising a cleaning member provided upstream of the transfer nip in the rotation direction of the transfer belt and adapted to clean the inner surface of the transfer belt by coming into contact with the inner surface of the transfer belt.

5. An image forming apparatus according to claim 4, further comprising a frame that supports the cleaning member and equipped with a receiving unit.

6. An image forming apparatus according to claim 1, wherein the contact member is a transfer sheet, one end of which is fixed by the support member and another end of which is a free end, and the transfer sheet contacts the belt on a surface between the one end and the free end.

7. An image forming apparatus according to claim 6, wherein the transfer unit includes an elastic member that presses the transfer sheet toward the transfer belt.

8. An image forming apparatus according to claim 6, wherein the transfer sheet adheres to the transfer belt by applying a voltage to the transfer sheet, and a force by which the transfer sheet electrostatically adheres to the transfer belt is reduced by turning the voltage applied to the transfer sheet off.

9. An image forming apparatus according to claim 8, further comprising a charge member configured to charge the rotatable image bearing member, wherein in a case of the cleaning mode, the control part stops application of voltage to the charge member before the transfer belt rotates in an opposite direction.

10. An image forming apparatus according to claim 1, wherein the cleaning mode is performed after the toner image is transferred from the image bearing member to the transfer belt and toner remaining on the image bearing member and the transfer belt are recovered.

11. An image forming apparatus according to claim 1, wherein the transfer belt is an intermediate transfer belt to which the toner image is transferred.

12. An image forming apparatus according to claim 1, wherein the transfer belt is a transfer material conveyance belt adapted to transfer the transfer material to which the toner image is transferred.

* * * * *